US010745033B2

(12) United States Patent
Krismanic et al.

(10) Patent No.: US 10,745,033 B2
(45) Date of Patent: Aug. 18, 2020

(54) PNEUMATIC PUMP DEVICE AND METERING SYSTEM AND SANDING SYSTEM, COMPRISING A JET PUMP FOR FLOWABLE MATERIAL

(71) Applicant: KNORR-BREMSE GESELLSCHAFT MIT BESCHRÄNKTER HAFTUNG, Mödling (AT)

(72) Inventors: Georg Krismanic, Vienna (AT); Albert Schneider, Vienna (AT)

(73) Assignee: KNORR-BREMSE GESELLSCHAFT MIT BESCHRÄNKTER HAFTUNG (AT)

( * ) Notice: Subject to any disclaimer, the term of this patent is extended or adjusted under 35 U.S.C. 154(b) by 331 days.

(21) Appl. No.: 15/553,802

(22) PCT Filed: Feb. 24, 2016

(86) PCT No.: PCT/AT2016/050042
§ 371 (c)(1),
(2) Date: Aug. 25, 2017

(87) PCT Pub. No.: WO2016/134397
PCT Pub. Date: Sep. 1, 2016

(65) Prior Publication Data

US 2018/0072329 A1 Mar. 15, 2018

(30) Foreign Application Priority Data

Feb. 26, 2015 (AT) ..... 50154/2015

(51) Int. Cl.
*B61C 15/10* (2006.01)
*F04F 5/24* (2006.01)
*F04F 5/46* (2006.01)

(52) U.S. Cl.
CPC ..... *B61C 15/102* (2013.01); *B61C 15/10* (2013.01); *F04F 5/24* (2013.01); *F04F 5/46* (2013.01)

(58) Field of Classification Search
CPC ..... B61C 15/00; B61C 15/08; B61C 15/10; B61C 15/102; B61C 15/105; B61C 15/14
See application file for complete search history.

(56) References Cited

U.S. PATENT DOCUMENTS 2,614,002 A 10/1952 Snow

FOREIGN PATENT DOCUMENTS

DE 29 38 583 A1 4/1981
DE 20 2013 000 635 U1 4/2013
(Continued)

OTHER PUBLICATIONS

International Search Report for International Patent Application No. PCT/AT2016/050042; dated Jul. 29, 2016.

*Primary Examiner* — Robert J McCarry, Jr.
(74) *Attorney, Agent, or Firm* — Barnes & Thornburg LLP

(57) ABSTRACT

A pneumatic pump device coupled to a container for flowable material includes a jet pump with at least one intake duct extending away from the container and leading into the jet pump and an air supply duct extending away from the container and to which pressure can be applied or which leads to an outer surface of the pneumatic pump device. The intake duct and air supply duct have essentially the same orientation in the region of the container and are advantageously inclined relative to the vertical by not more than 40°. A metering system includes a container and such a pneumatic pump device coupled thereto and the use of the pneumatic pump device or metering system in a sanding system of a rail vehicle.

27 Claims, 9 Drawing Sheets

(56) References Cited

FOREIGN PATENT DOCUMENTS

| | | | | | |
|---|---|---|---|---|---|
| EP | 0016471 | A1 * | 10/1980 | ..... | B61C 15/10 |
| EP | 0016471 | A1 | 10/1980 | | |
| EP | 0 499 199 | A2 | 8/1992 | | |
| GB | 2 192 371 | A | 1/1988 | | |

* cited by examiner

PNEUMATIC PUMP DEVICE AND METERING SYSTEM AND SANDING SYSTEM, COMPRISING A JET PUMP FOR FLOWABLE MATERIAL

PRIORITY CLAIM

This patent application is a U.S. National Phase of International Patent Application No. PCT/AT2016/050042, filed Feb. 24, 2016, which claims priority to Austrian Patent Application No. A 50154/2015, filed Feb. 26, 2015, the disclosures of which are incorporated herein by reference in their entirety.

FIELD

Disclosed embodiments relate to a pneumatic pump device for coupling with a container for flowable material, which includes a contact surface which is intended for contact with the flowable material.

SUMMARY

In accordance with disclosed embodiments, a pneumatic pump device includes a jet pump having a mixing chamber, a jet nozzle which is able to be acted upon with pressure and opens out into the mixing chamber and having at least one suction duct which leads away from contact surface and opens out into the mixing chamber. In addition, the pneumatic pump device includes at least one supply air duct which leads away from the contact surface and can be acted upon with pressure or opens out at an outside surface of the pneumatic pump device. The at least one suction duct and the at least one supply air duct realize at least one suction opening and at least one supply air opening in the region of the contact surface.

In addition, disclosed embodiments relate to a metering system having a container for receiving flowable material and a pneumatic pump device of the named type coupled with the named container, wherein the contact surface of the pneumatic pump device points into an interior of the container.

Disclosed embodiments relate to the advantageous use of the pneumatic pump device, in particular in a sanding system of a rail vehicle, as well as to the use of the metering system also in a sanding system of a rail vehicle. Finally, disclosed embodiments relate to a sanding system or a spreader and a rail vehicle as such.

BRIEF DESCRIPTION OF FIGURES

Advantageous designs and further developments of the disclosed embodiments are provided in the description in conjunction with the figures. For the better understanding of the disclosed embodiments, those embodiments are explained in more detail by way of the following figures, which provide highly simplified schematic representations in which.

DETAILED DESCRIPTION

Figure 1:
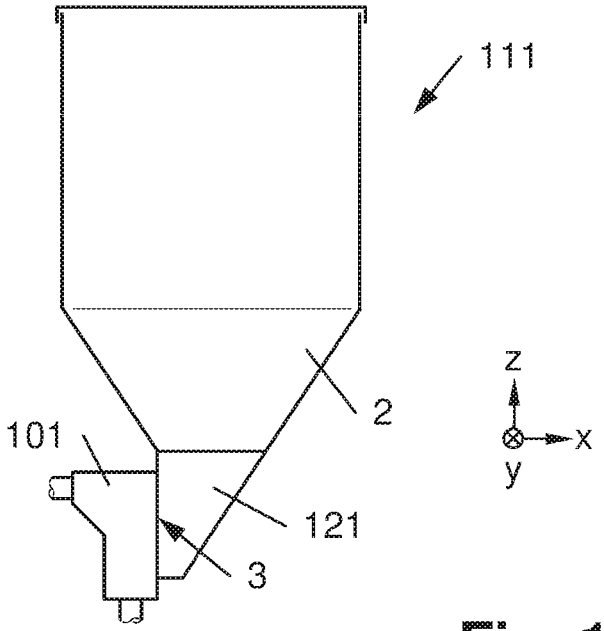
FIG. 1 shows a first schematically shown example of a metering system with a first design of a pneumatic pump device.

Generally, a pneumatic pump device serves for pumping and portioning or metering flowable material, for example granulate, sand or the like. Its area of application lies in industrial installations but also in sanding systems of rail vehicles where it is used for metering brake sand. The sand spread in front of the wheels of the rail vehicle increases the traction of the same when braking and starting up.

A pneumatic pump device and a metering system of the above-named type, in particular in conjunction with a sanding system of a rail vehicle, are disclosed in principle in the prior art. For example, EP 2 100 788 B1 discloses to this end a pneumatic pump device which includes a cylindrical or tower-shaped housing which is arranged in the bottom region of a sand container. The housing includes multiple radially distributed suction bores and multiple radially distributed supply air bores. The housing projects from below into the sand container such that the named bores lie in the container.

A disadvantage of that pump device is that, due to its design, it provides "shadow areas" from which the brake sand is not removed. The container can consequently not be completely emptied, as a result of which in particular fine-grained parts of the brake sand are gradually deposited in the bottom region and form clumps there. A further consequence is that more and more sand sticks to the raw surfaces of the clumps, as a result of which the suction openings of the pneumatic pump device ultimately become blocked.

The problem occurs more particularly in the case of multi systems where multiple pneumatic pumps project into the sand container and consequently particularly severe intersections occur in which the brake sand can be "easily" deposited. In addition, the pneumatic pumps can influence one another in a relatively marked manner, in particular when the suction openings face one another. When the pump devices are installed in the sand container, on account of the cylindrical form specific measures are consequently to be taken such that they are installed in a desired position and are not twisted. A further problem in the case of multi systems is that the pneumatic pump devices cannot be installed at the lowest point of the sand container, which further promotes unwanted deposits. In addition, the connections for the pressure lines and the transport lines are potentially at an angle, which causes problems when connecting to the pipe network of the rail vehicle, or rather complicates the installation of the sanding system.

A further disadvantage of the known pump device is that, on account of mounting the pump device beneath the sand container, the overall height of the metering system is relatively large, which can result in problems with the restricted installation space in modern rail vehicles. In addition, a transport line to the wheels of the rail vehicle, as a rule, has to be run horizontally at least in portions, which calls for the use of a 90° elbow or bend. The problem here is that, on account of the abrasive action of the brake sand and of the high air speed in the transport line (supersonic speeds can be achieved, in part, on account of a Laval nozzle built into the pneumatic pump), such a bend, insofar as it is not specifically strengthened, wears through in a relatively short time, which implies maintenance on the sanding system which is time-consuming and cost-intensive, including the stoppage of the rail vehicle.

As a result of the low-lying position of the pneumatic pump device, it is also unable to be protected or is protected in a very unsatisfactory manner from the effects of the weather, as a result of which, on the one hand, it is susceptible to faults, on the other hand has none too high a life expectancy. In addition, on account of the low-lying position, the transport lines, as a rule, have to comprise ascending portions in which, however, the brake sand can only be transported, with difficulty.

Disclosed embodiments provide an improved pneumatic pump device, an improved metering system, an improved sanding system and an improved rail vehicle. In particular, the above-named problems are to be avoided at the same time.

This may be achieved with a pneumatic pump device of the type named in the introduction, where the at least one suction duct and the at least one supply air duct are oriented substantially identically in the region of the contact surface, wherein, when the pneumatic pump device is operating, the flow directions in the at least one suction duct and in the at least one supply air duct are aligned in an anti-parallel manner. In particular, multiple suction ducts and multiple supply air ducts are oriented substantially identically in the region of the contact surface.

This may also be achieved with the use of the pneumatic pump device of the named type for sucking up the flowable material from the named container, the at least one suction duct and the at least one supply air duct being at an angle of no more than 40° in relation to the vertical in the region of the contact surface.

Further, this may be achieved with a metering system which includes a container for receiving flowable material and a pneumatic pump device of the named type which is coupled to the named container, wherein the contact surface of the pneumatic pump device points into an interior of the container.

This may also be achieved by the use of the pneumatic pump device of the named type or rather of a metering system of the named type in a sanding system of a rail vehicle, brake sand being provided as flowable material.

Finally, this may be achieved by a sanding system for a rail vehicle having a metering system of the named type and by a rail vehicle having such a sanding system.

Advantageously, the overall height of the metering system compared to that disclosed in EP 2 100 788 B1 may be reduced by the proposed measures, as a result of which the installation—for example in a rail vehicle—is simplified. As a result of the somewhat high-mounted position of the pneumatic pump device, it is able to be very well protected from the influences of the weather, as a result of which, on the one hand, it is less susceptible to faults, and on the other hand, it also has a comparatively long life expectancy. Ascending portions in transport lines can be extensively avoided, as a result of which the transport line operates better.

In general, the statement "substantially" within the framework of the invention means, in particular, a deviation of ±10° in the case of angle information or of ±10% in the case of other information. A "substantially identical orientation" of the at least one suction duct and of the at least one supply air duct in the region of the contact surface can also be understood in particular as each (spatial) angle a) between a suction duct and a supply air duct and/or b) between two suction ducts and/or c) between two supply air ducts being less than 30° in the region of the contact surface.

The statement that the pneumatic pump device is "coupled" with the container, means direct attachment of the pneumatic pump device on the container or indirect attachment, for example by means of an interposed adapter. The statement that the contact surface of the pneumatic pump device points "into the interior of the container" can consequently also mean analogously that the contact surface points "into an interior of an adapter". In general, the delimitation between container, adapter and pneumatic pump device is arbitrary. In principle, the adapter can be viewed as an independent component, as belonging to the container or as belonging to the pneumatic pump device. In particular, the function of the adapter can be integrated in the pneumatic pump device.

It is favorable when the contact surface is level. As a result, it is possible to produce the pneumatic pump device using simple technical means.

However, it is also favorable when the contact surface is curved concavely or convexly. As a result, the suction openings and the supply air openings are arranged offset somewhat with respect to one another at different depths, as a result of which the flow conditions in the container can be further optimized.

It is particularly advantageous when the at least one supply air opening is realized with a smaller cross section than the at least one suction opening. Under unfavorable conditions, the transport line can become blocked and consequently the flow conditions reversed. The compressed air supplied to the pneumatic pump device can then no longer escape by means of the transport line, but instead is blown, counter to the actually provided flow direction, through the suction ducts into the container for the flowable material and, as a further consequence, counter to the planned flow direction, through the supply air ducts. Entrained material can consequently result in blockages in the supply air ducts and consequently in increased expenditure on maintenance. If the supply air openings are now realized smaller than the suction opening, the disadvantageous effect is able to be avoided or at least reduced.

Optionally, the pneumatic pump device comprises multiple suction openings of multiple suction ducts arranged on the contact surface along a first straight line and multiple supply air openings of multiple supply air ducts arranged on the contact surface along a second straight line parallel to the first straight line. In the context, it is also possible that the first straight line and the second straight line are aligned substantially horizontally when the pneumatic pump device is in use. As a result, on the one hand, the pneumatic pump device is comparatively simple to produce, as a result on the other hand, favorable flow conditions are also produced in the container. The flowable material is dug out and transported to the suction openings as it were "on a broad front" by the supply air openings lying on a straight line.

Optionally, the pneumatic sand pump device comprises a Laval nozzle which is arranged downstream of the mixing chamber in the pumping direction of the flowable material. In this way, the flow speed in the transport line can be increased, potentially even to supersonic speed.

Optionally, a jet direction of the jet nozzle is aligned horizontally or comprises a horizontal component. In this way, a horizontally run transport line, just as occurs in particular in the case of sanding systems of rail vehicles, can be connected directly to the pneumatic pump device, that is to say without any bend or elbow. Defects and stoppage times on account of a worn-through pipe bend can consequently be avoided.

Optionally, a straight portion of the at least one suction duct which begins at the contact surface is guided further away from the contact surface than a straight portion of the at least one supply air duct which begins at the contact surface. In this way, the jet nozzle and the pneumatic system connected thereto is further removed from the contact surface, or rather is arranged in a different plane, than the supply air ducts. The structural freedom when aligning the jet nozzle and consequently the connection for the transport line is consequently particularly large as there are not any or only a few spatial intersections between the suction system and the supply air or false air system.

Optionally, a supply air opening nearest to a suction opening is arranged above the named suction opening when the pneumatic pump device is in use. As a result, discharging the flowable material and complete emptying of the container are supported as flowable material is blown toward the suction openings by means of the supply air/false air and gravity.

Optionally, a straight portion of the at least one suction duct which begins at the contact surface and a straight portion of the at least one supply air duct which begins at the contact surface are at an angle with respect to one another away from the pneumatic pump device in the direction of the container. In particular, a straight portion of the at least one suction duct which begins at the contact surface and a straight portion of the at least one supply air duct which begins at the contact surface can enclose an angle which opens in the direction toward the pneumatic pump device away from the container. In particular, an axis of the named straight portion of the suction duct and an axis of the named straight portion of the supply air duct can have an intersection point inside the container or adapter. As a result of the measures, discharging the flowable material out of the container/adapter and the complete emptying thereof are further favored. This is because the air flow emerging from the at least one supply air duct blows the flowable material toward the at least one suction opening. This is not so in the case of arrangements according to the prior art. For example, the supply air openings in the case of EP 2 100 788 B1 are aligned tangentially and consequently not to the suction openings, as a result of which the sand is blown away from the suction openings by the air flowing out of the supply air openings.

Also, optionally, the contact surface of the pneumatic pump device is aligned vertically when the pump is in use. As a result, deposits in the region of the suction openings and supply air openings are avoided. However, it is also possible that the contact surface is at somewhat of an angle from the vertical and is aligned overhanging. In this way, deposits in the region of the suction openings and supply air openings can be prevented in an even better manner.

Optionally, the pneumatic pump device is arranged in its entirety outside the named container. In this way, intersections in the interior of the container are avoided, that is to say the container is extensively smooth inside as the pneumatic pump device does not project into the container. Consequently, neither are there any "shadow regions" from which the brake sand is not removed, but rather it is possible to empty the container completely. Deposits and clumps of flowable material and blockages consequently associated therewith which threaten to develop over the long-term in the suction openings can consequently be avoided.

Optionally, the container tapers toward the contact surface of the pneumatic pump device. This also promotes complete emptying of the container, as a result of which deposits and the negative effects associated therewith are prevented.

Optionally, the tapering part of the container is formed by an adapter at least in the end region. As a result, different designs of pneumatic pump devices and/or various numbers of pneumatic pump devices can be coupled with the container for the flowable material in a simple manner. In this context, a modular system may comprise a metering system and at least two differently designed adapters.

Optionally, the metering system comprises a blow-out device which includes blow-out ducts which are arranged in the pumping direction of the flowable material behind the mixing chamber and where applicable behind a Laval nozzle, are aligned at an angle to the pumping direction of the flowable material and point in the named pumping direction. In this way, a transport line can be cleaned or flowable material residue can be removed. The pressure, in this case, may be adjusted such that the flowable material is barely sucked by means of the suction ducts. The blow-out device can be realized as a separate part which is connected, when necessary, to the pneumatic pump device, or can also directly be part of the pneumatic pump device. It is also conceivable for a blow-out device to be arranged in the further course of the transport line. In general, it is also imaginable for the pressure at the jet nozzle to be lowered for blowing-out a transport line until no flowable material is sucked by means of the suction ducts. The measure can be provided in addition to or as an alternative to the blow-out device.

It is additionally possible that the metering system comprises a heating unit and/or at least one hot air duct which opens out into a (storage) space for the flowable material. For example, the heating unit can be formed by an electric heating element. In particular, it can be provided that compressed air is guided over a heating element, is heated and dried there and then is blown via a hot air duct or multiple hot air ducts into a space for the flowable material in order to heat and dry the flowable material. As a result, clumping of the flowable material can be prevented. The heating unit or rather the at least one hot air duct can be arranged in the above-named adapter, in a heating flange which is arranged between the pneumatic pump device and the adapter, or also directly in the pneumatic pump device itself.

It is also possible that a metering system comprises multiple pneumatic pump devices connected to a container. As a result, the material sucked out of the container can be fed into various pipe systems which can be activated in particular in varying ways. On account of the proposed design, the pneumatic pump devices do not influence one another or only influence one another a little, and it is also possible to arrange all the pneumatic pump devices at the lowest point of the container for the flowable material. Accordingly, the container can be emptied completely in practice with any of the pneumatic pump devices.

It is additionally optional, in the above context, that at least two pneumatic pump devices are designed differently. In this way, the manner in which the pipe systems are to be supplied or also a different requirement for output can be taken into consideration. In particular, the connections for the transport lines and/or the pressure lines can point in different directions in order, for example, to simplify installation of the metering system into an existing pipe system and, in particular, to reduce the use of pipe elbows where possible.

It is possible that the distance between a suction opening and the nearest supply air opening is no more than 30 mm. As a result of the spatial proximity of the supply air openings and the suction openings, the delivered mass flow is practically independent of the fill level in the sand container. In addition, removal of the brake sand and complete emptying of the sand container is also promoted as a result of the developing air flow.

With this understanding in mind, it should be understood that in, the differently described embodiments, identical parts are provided with identical reference symbols or identical component references, the disclosures included in the entire description being able to be transferred analogously to identical parts with identical reference symbols or identical component references. Positional information selected in the description, such as, for example, up, down, to the side etc. also refers to the figure directly described and shown and where there is a change in position is to be transferred analogously to the new position. In addition, individual features or feature combinations from the different exemplary embodiments shown and described can provide inventive solutions.

Figure 2:
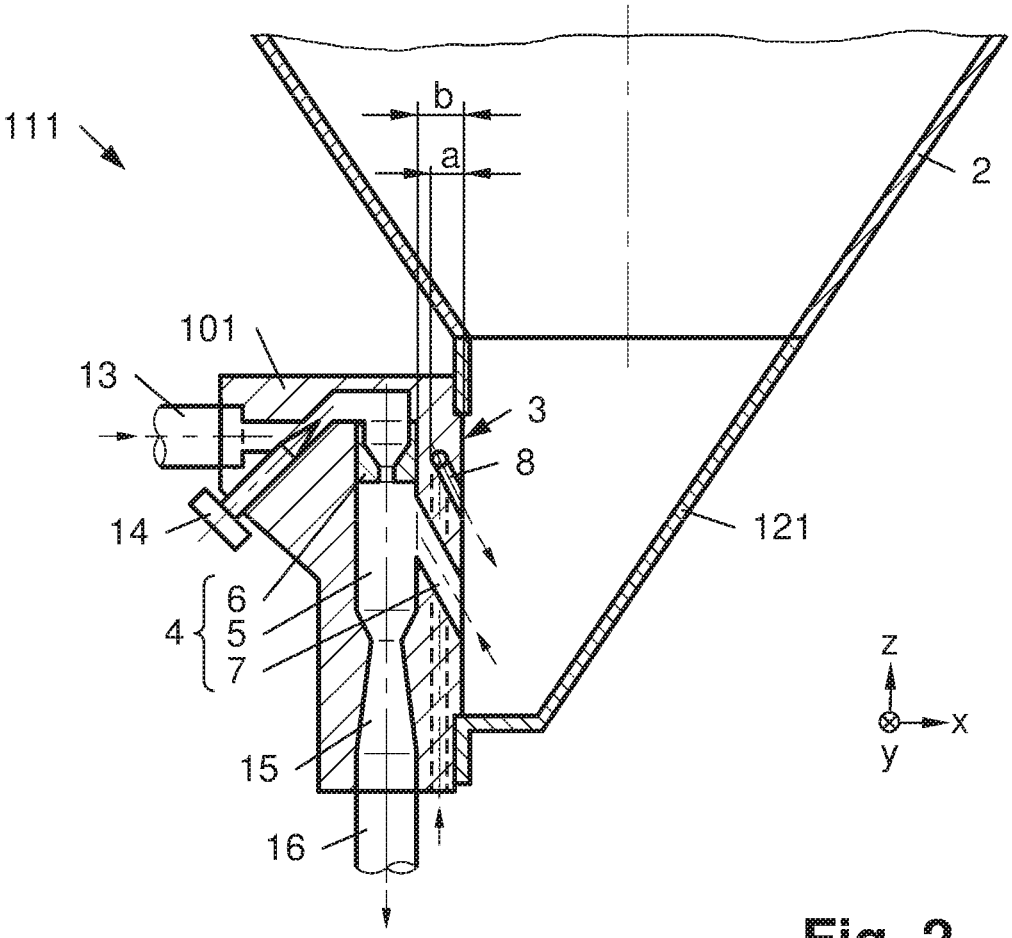
FIG. 2 shows a section through the pneumatic pump device from FIG. 1 in the bottom region of the container for the flowable material.
Figure 3:
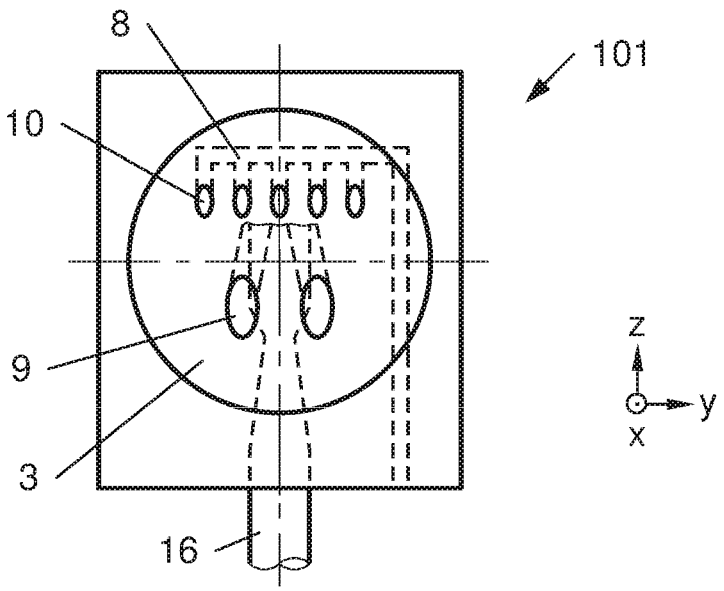
FIG. 3 shows a side view of the pneumatic pump device from FIG. 2.

A first example of a pneumatic pump device 101 is explained by way of FIGS. 1 to 3, FIG. 1 showing a schematic overview image, FIG. 2 showing a detailed sectional representation of the pneumatic pump device 101 coupled with a container 2 and FIG. 3 showing a side view of the pneumatic pump device 101. The container 2, in this case, is provided for receiving flowable material. For better orientation, an xyz coordinate system is shown in FIGS. 2 and 3, and in the majority of the subsequent figures.

The pneumatic pump device 101 includes a contact surface 3 which is intended for contact with the flowable material, as well as a jet pump 4 with a mixing chamber 5, a jet nozzle 6 which can be acted upon with pressure and opens out into the mixing chamber 5, and with at least one suction duct 7 which leads away from the contact surface 3 and opens out into the mixing chamber 5. Over and above this, the pneumatic pump device 101 includes at least one supply air duct 8 which leads away from the contact surface 3 and opens out at an outer surface of the pneumatic pump device 101. Two suction ducts 7 and five supply air ducts 8 are provided in the specifically shown example. These numbers, however, are purely illustrative and a different number of suction ducts 7 and supply air ducts 8 can also be provided (compare FIG. 8). In principle, the suction ducts 7 and supply air ducts 8 can comprise an arbitrary cross section; however, optionally, when they are realized as bores or with an elongated (oval) cross section.

The suction ducts 7 and the supply air ducts 8 are orientated identically in the region of the contact surface 3, the flow directions in the suction ducts 7 and in the supply air ducts 8 being aligned in an anti-parallel manner when the pneumatic pump device 101 is in operation. In addition, the suction ducts 7 and the supply air ducts 8 realize at least suction openings 9 and supply air openings 10 in the region of the contact surface 3. FIG. 3 shows the airflow in the interior of the pneumatic pump device 101 in part. Part of the mixing chamber 5 and the jet nozzle 6, however, are not shown for better clarity. With regard to the incision for the representation in FIG. 2, it is additionally to be noted that both a suction duct 7 and a supply air duct 8 are shown located in the cutting plane in order to facilitate understanding of the function of the pneumatic pump device 101.

The pneumatic pump device 101 and the container 2 together form a metering system 111, the coupling of the pneumatic pump device 101 with the container 2 being effected in the specifically shown example by means of an optional adapter 121, which is, however, consequently also part of the metering system 111. In principle, however, the pneumatic pump device 101 can also be attached directly to the container 2, or rather the adapter 121 can also be understood as part of the container 2.

The function of the arrangement shown in FIGS. 1 to 3 is then as follows, it being assumed that the container 2 is filled with flowable material:

Compressed air is blown into the pneumatic pump device 101 by means of a compressed air connection 13. The pressure can be adjusted in this example by means of the pressure adjusting screw 14. However, also conceivable, for example, is the use of a pressure reducer. The compressed air then flows via the jet nozzle 6 into the mixing chamber 5, as a result of which flowable material is sucked out of the container 2 or rather the adapter 121 via the suction ducts 7 on account of the Venturi effect or rather on account of the vacuum forming in the mixing chamber 5 in a manner known per se. The material is pumped away in a downward direction via a transport line 16 by means of an optional Laval nozzle 15 which increases the flow speed. Pressure equalization can be effected by means of the supply air ducts 8, that is to say the air sucked through the suction ducts 7 flows via the supply air ducts 8. The flow direction of the air is indicated with arrows in FIG. 2.

In the named example, the supply air ducts 8 lead to an outer surface of the pneumatic pump device 101 and open out there into an environment of the pump device 101. That is to say that ambient air or false air is sucked in via the supply air ducts 8. However, this is not absolutely necessarily the case. It is, in fact, also conceivable for the supply air ducts 8 to be connected instead to a compressed air system and air to be run accordingly out of the compressed air system to the supply air ducts 8. For example, unwanted ingress of water, water vapor/moisture, foreign bodies and/or animals into the container 2 can be prevented in this way as the air sucked in by a compressor and fed into the compressed air system is, as a rule, filtered and dried.

To obtain suitable pressure, a pressure reducer, in particular, can be provided in front of the supply air ducts 8. The air supplied to the named pressure reducer can originate directly from the compressed air system or can also be branched off behind the pressure adjusting screw 14 or behind a pressure reducer provided for the jet nozzle 6. The pressure for the supply air ducts 8 can be independent of the pressure provided for the jet nozzle 6 or can also be independent of the same. In particular the pressure for the supply air ducts 8 can also be constant. Optionally, an air source is connected to the supply air ducts 8 and the pressure at the supply air ducts 8 is consequently extensively independent of the volume flow flowing through the supply air ducts 8. It also optional that the pressure for the supply air ducts 8 in a lower pressure range to be proportional to the pressure for the jet nozzle 6, but to be limited to a maximum pressure. This can be realized, for example, with a non-return valve or a bypass valve.

It is also noted at this point that the supply air ducts 8 can be supplied, on the one hand, from the ambient air and, on the other hand, by compressed air.

FIG. 2 then shows that straight portions of the suction ducts 7 which begin on the contact surface 3 lead further away from the contact surface 3 than straight portions of the supply air ducts 8 which begin on the contact surface 3. Specifically, the named straight portions of the supply air ducts 8 lead only up to a distance a away from the contact surface 3, whereas the suction ducts 7 lead up to a distance b away from the contact surface 3. This is to say that the jet nozzle 6 is arranged in a different plane (here located further away from the contact surface 3) to the supply air ducts 8. Optionally, the jet pump 4, the optional Laval nozzle 15 and the transport line 16 can be arranged in practice in an arbitrary spatial direction. In particular, the pneumatic pump device 101 can be rotated about an axis standing normally on the contact surface 3 (see also FIGS. 5 and 6). As a result, in practice, the transport line 16 can be aligned in an arbitrary direction and the pneumatic pump device 101 can easily be adapted to various installation situations without an elbow or rather pipe bend being necessary close to the pneumatic pump device 101, as is often the case with known solutions. As a result, a defect which is based on such a pipe bend that is worn through from the inside is able to be avoided.

In the case of the variant of the pneumatic pump device 101 shown, the axis of the jet nozzle 6 and the axis of the container 2 do not intersect one another. This is optional but not absolutely necessary. It would also be conceivable for the axis of the jet nozzle 6 and the axis of the container 2 to intersect one another.

It can additionally be seen from FIG. 2 that the contact surface 3, which is level here, is aligned in a vertical manner. In this way, deposits in the region of the suction openings 9 and supply air openings 10 can be avoided. In principle, the contact surface 3 could, however, also be at an angle in relation to the vertical, in particular overhanging to the right. In this way, deposits in the region of the suction openings 9 and supply air openings 10 can be avoided particularly well.

It can also be seen that the supply air openings 10 may be arranged above the suction openings 9. As a result, removing flowable material and completely emptying the container 2 or rather the adapter 121 is supported as flowable material is blown toward the suction openings 9 by means of the supply air/false air.

Optionally, a supply air opening 10—as shown in FIG. 3—is realized smaller in cross section than a suction opening 9. This prevents, when there is a reversal in flow conditions as can occur in the case of a blockage in the transport line 16, flowable material being blown into the supply air ducts 8. In the case of the operating state, the compressed air blown-in via the compressed air connection 13 cannot be removed as actually provided via the transport line 16, but is blown into the container 2 counter to the flow direction shown in FIG. 2 via the suction ducts 7 and removed via the supply air ducts 8. Where the supply air ducts 8 are designed in an unsuitable manner, they can become blocked, which implies maintenance work on the pneumatic pump device 101 along with the maintenance work on the transport line 16.

Figure 4:
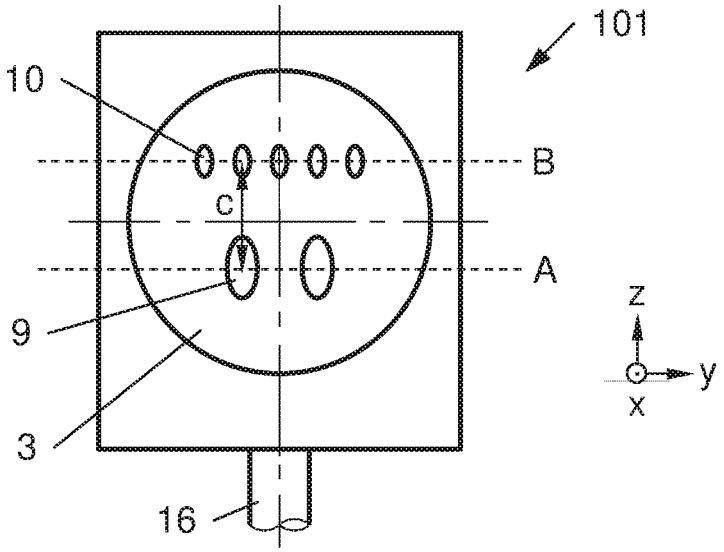
FIG. 4 is as FIG. 3, only the air guiding in the interior of the pneumatic pump device is not shown in a visible manner.

Optionally, multiple suction openings 9 of multiple suction ducts 7 are arranged on the contact surface 3 along a first straight line A and multiple supply air openings 10 of multiple supply air ducts 8 are arranged on the contact surface 3 along a second straight line B which is parallel to the first straight line A, as is shown in FIG. 4. In FIG. 4, which corresponds to FIG. 3 but does not show the hidden airflow, all the suction openings 9 are actually arranged on a first straight line A and all the supply air openings 10 are arranged on a second straight line B. The first straight line A and the second straight line B, in this case, are aligned substantially horizontally. As a result, the production of the pneumatic pump device can be simplified without compromises having to be made regarding the emptying of the container 2.

Optionally, the pneumatic pump device 101, as shown in FIGS. 1 to 4, may be arranged in its entirety outside the container 2 or rather the adapter 121. This may favor complete emptying of the container 2 or rather of the adapter 121, and depositing of the flowable material which, in the worst case, can result in clumping and blockage of the installation, is prevented.

Optionally, a further feature which favors complete emptying is that the container 2 tapers toward the contact surface 3 of the pneumatic pump device 1, it being possible for the tapering part also to be formed in the end region of the container 2—as shown—by an adapter 121. Optionally, the container 2 or rather the adapter 121, as shown, may taper asymmetrically toward the contact surface 3.

Figure 5:
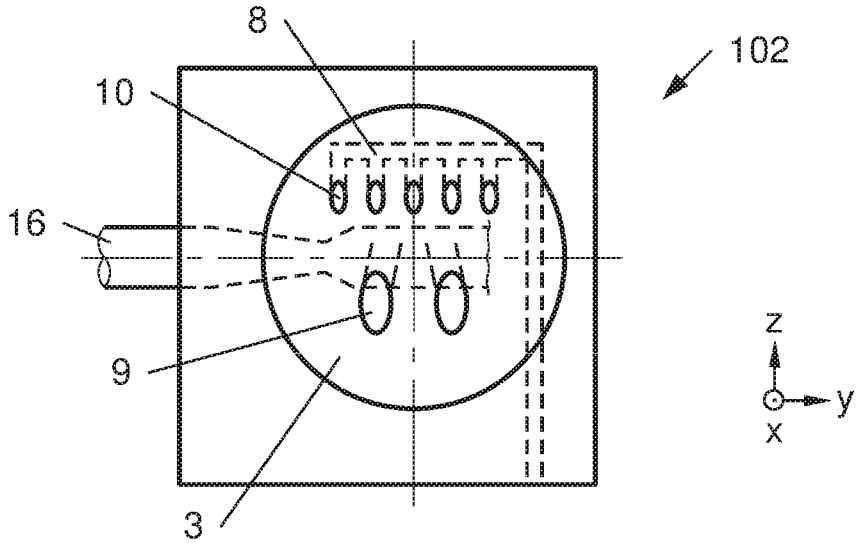
FIG. 5 shows a side view of a pneumatic pump device with a horizontally aligned connection for a transport line.

FIG. 5 then shows a side view of a pneumatic pump device 102 which is very similar to the pneumatic pump device 101. In contrast thereto, the jet direction of the jet nozzle 6 and consequently also the transport line 16 is, however, aligned horizontally. Consequently, the flowable material can also be removed horizontally without an elbow or bend having to be installed in the course of the line for that purpose.

Figure 6:
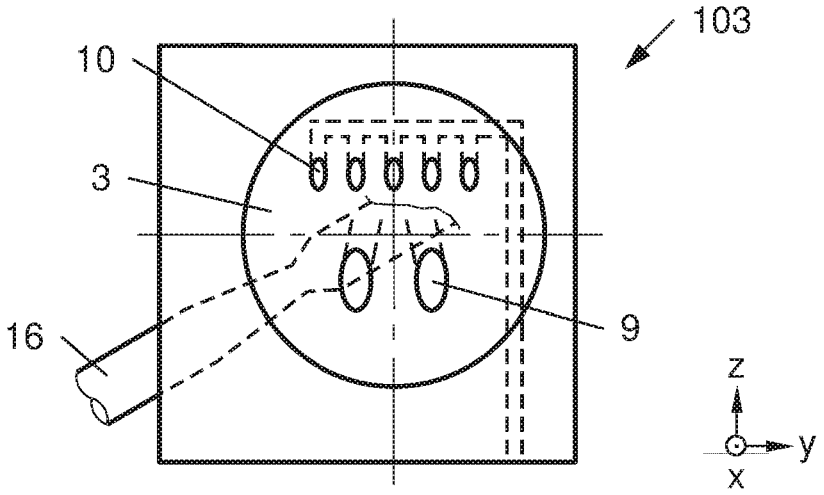
FIG. 6 shows a side view of a pneumatic pump device with a connection for a transport line aligned at an angle.

FIG. 6 shows a side view of a further pneumatic pump device 103 which is very similar to the pneumatic pump devices 101 and 102. In contrast thereto, the jet direction of the jet nozzle 6 and consequently also the transport line 16 is, however, aligned at an angle. That is to say that the jet direction of the jet nozzle 6 comprises a horizontal component. Consequently, the flowable material can also be removed in an angled direction without an elbow or bend having to be installed in the course of the line for that purpose.

Figure 7:
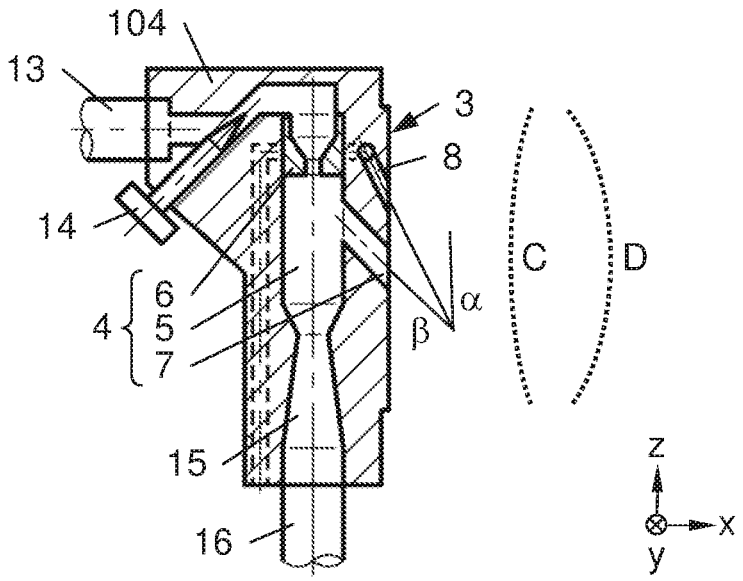
FIG. 7 shows a section through a further design of a pneumatic pump device with variously aligned suction ducts and supply air ducts.
Figure 8:
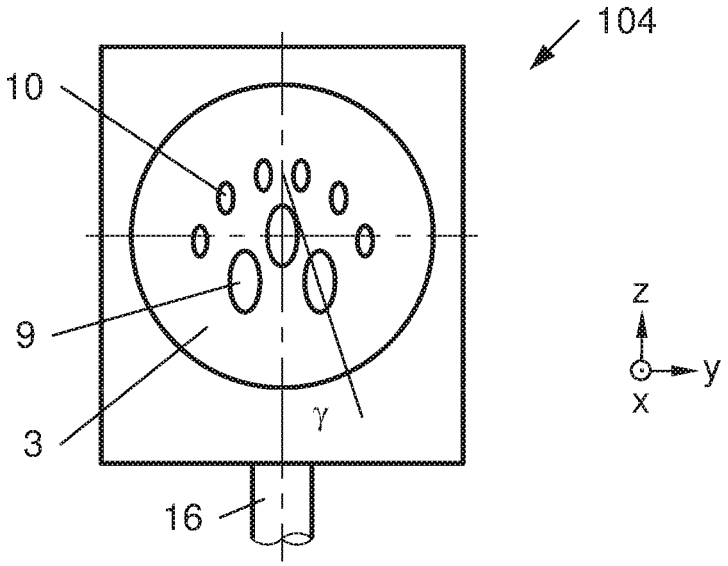
FIG. 8 shows a side view of the pneumatic pump device from FIG. 7.

FIGS. 7 and 8 show a further design of a pneumatic pump device 104, which is also very similar to the pneumatic pump device 101 from FIGS. 1 to 4. It can be seen from FIG. 7 (and also from FIG. 2) that the suction ducts 7 and the supply air ducts 8 are angled in relation to the vertical z in the region of the contact surface 3. In the specific example, the supply air ducts 8 are angled by the angle $\alpha$ and the suction ducts 7 are angled by the angle $\alpha+\beta$ in relation to the vertical. This is to say that the supply air ducts 8 are at a somewhat steeper angle than the suction ducts 7, which favors complete emptying of the container 2, or rather of the adapter 121, even further.

Specifically, a straight portion of a suction duct 7 which begins at the contact surface 3 and a straight portion of a supply air duct 8 which begins at the contact surface 3 are at an angle with respect to one another away from the pneumatic pump device 100 . . . 105 in the direction of the container 2. In particular, the two named straight portions enclose the angle β which opens away from the container 2 in the direction of the pneumatic pump device 104, and the axes of the two named straight portions have an intersection point in the container 2 or rather in the adapter 121.

In contrast thereto, the suction ducts 7 and the supply air ducts 8 of the pneumatic pump device 101 shown in FIG. 2 are angled in relation to the vertical by the identical angle α+β, that is to say are aligned in a parallel manner in the projection onto the xz plane. However, it is pointed out that the supply air ducts 8 in the pneumatic pump device 101 in FIG. 2 can also be angled differently and in particular more strongly than the suction ducts 7.

With regard to the incision for the representation in FIG. 7, it should be appreciated that both a suction duct 7 and a supply air duct 8 are shown as located in the cutting plane.

Optionally, each angle between a suction duct 7 and a supply air duct 8 and/or between two suction ducts 7 and/or between two supply air ducts 8 may be less than 30° in the region of the contact surface 3. In this way, the suction ducts 7 and the supply air ducts 8 are aligned in a substantially parallel manner, and an advantageous flow is realized in the container 2 or rather in the adapter 121.

The above-named angle, in this case, is to be understood as a spatial angle. For example, the angle between two suction ducts 7 when viewed in the xz plane is 0°, whereas the angle when viewed in the yz plane is 2γ. The direction of the right-hand suction duct 7 is marked for this purpose in FIG. 8. The spatial angle between the suction ducts 7 is accordingly a maximum of 2γ. The supply ducts 8 are assumed as parallel in the example shown in FIGS. 7 and 8. The spatial angle between the same is therefore 0°. Between the central suction duct 7 and a supply air duct 8 there is a spatial angle β, between a side suction duct 7 and a supply air duct 8 there is an angle composed of the angles β and γ together. In an advantageous manner, the named spatial angles are (all) to be less than 30°.

The flowable material flowing unintentionally out of the container is avoided as a result of the upwardly running suction ducts 7 and supply air ducts 8. A separate potential barrier for the flowable material is consequently avoided.

In the case of the pneumatic pump device 1 shown up to now, the contact surface 3 is realized in a level manner. However, this is not absolutely necessary. In further variants, the contact surface 3 can also be realized concavely (see the dotted line C in FIG. 7) or curved convexly (see the dot-dash line D). The curvature, in this case, can be both cylindrical and spherical.

A further difference between the pneumatic pump device 104 shown in FIGS. 7 and 8 and the pneumatic pump device 101 is that the supply air duct 8 is run beyond the plane provided in FIG. 2. The straight portions of the supply air ducts 8 leading away from the contact surface 3 certainly still reach only up to the distance a, however a collector pipe of the supply air system exceeds the distance a and is run up to behind the mixing chamber 5. This limits the design freedom in the case of the position of the jet nozzle 6 somewhat as it is simply one (single) duct which penetrates the plane of the jet nozzle (that is to say goes beyond the distance b), and not all the supply air ducts 8, the effects being clear. Where applicable, the named duct can naturally also be run in a different manner, in particular when the position and direction of the jet nozzle 6 so demand.

Finally, the suction openings 9 and the supply air opening 10 in FIG. 8 are not arranged on two straight lines A and B but are arranged in a somewhat arcuate manner. Variants, for example, where the suction openings 9 and supply air openings 10 are arranged alternately at the same height would also be conceivable.

Figure 9:
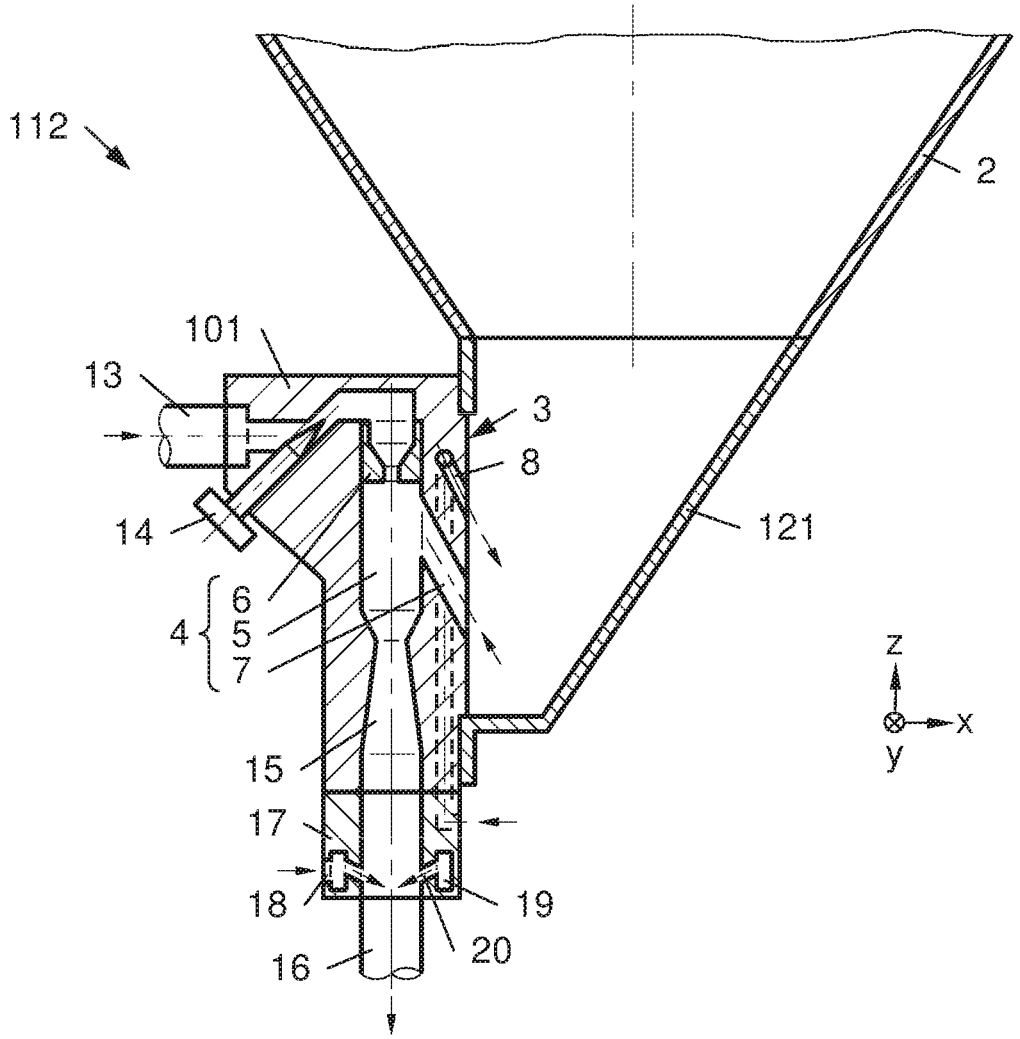
FIG. 9 shows a metering system with an attached blow-out device.

FIG. 9 shows a metering system 112 which is very similar to the metering system 111 shown in FIG. 2. In contrast thereto, a blow-out device 17 is provided which includes a compressed air connection 18, an annular duct 19 and multiple blow-out ducts 20 which are aligned at an angle to a pumping direction in the Laval nozzle 15 or rather in the transport line 16 and point in the named pumping direction. Air can be blown into the transport line 16 by means of the compressed air connection 18 without, in this case, flowable material necessarily being sucked in via the suction ducts 7. In this way, the transport line 16 can be cleaned or any residual flowable material can be removed. The pressure at the compressed air connection 18, in this case, is optionally adjusted such that the flowable material is barely sucked in via the suction ducts 7.

In general, the blow-out device 17 can be realized as a separate part which is connected, when required, to the pneumatic pump device 101, or is also directly part of the pneumatic pump device 101. It is naturally also conceivable for the (or a further) blow-out device 17 to be arranged in the further course of the transport line 16. It is additionally also conceivable for the pressure at the compressed air connection 13 for blowing out the transport line 16 to be lowered until no flowable material is sucked in via the suction ducts 7. The measure can be provided in addition to or as an alternative to the blow-out device 17.

Figure 10:
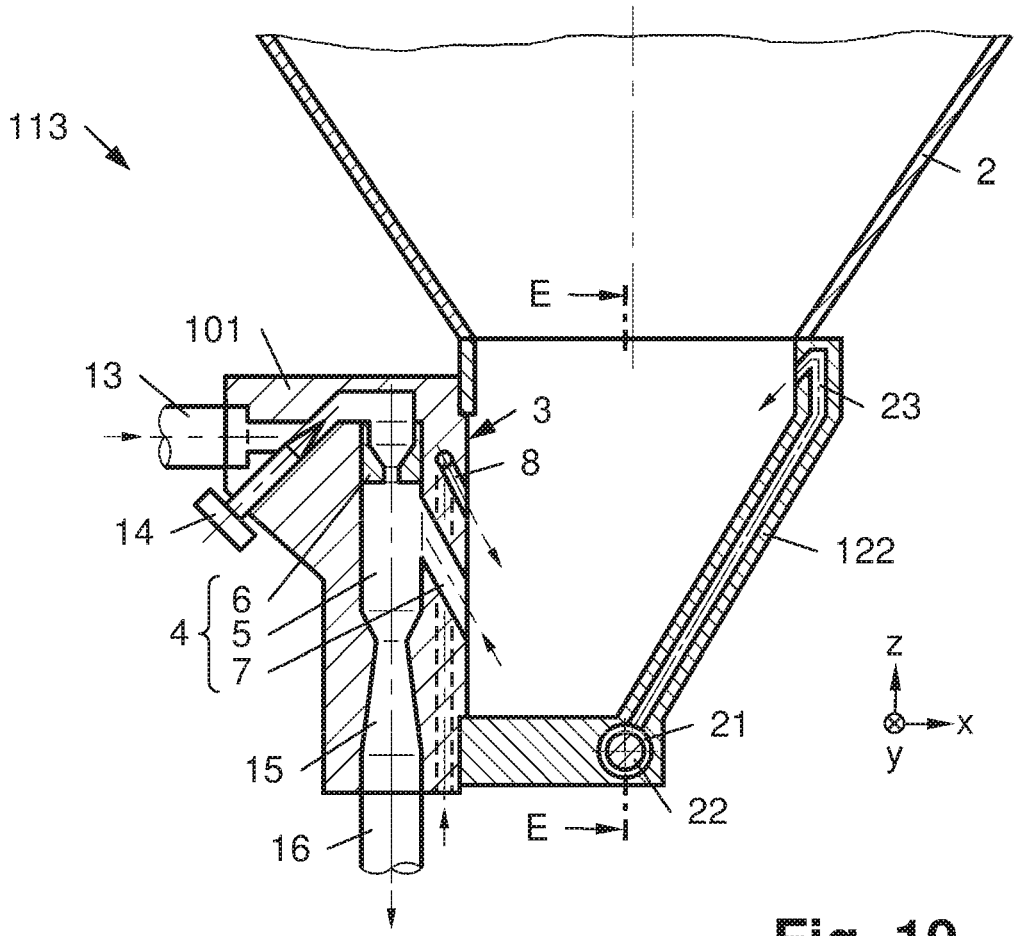
FIG. 10 shows a metering system with a heatable adapter.

FIG. 10 shows a further metering system 113 which is very similar to the metering system 111 shown in FIG. 2. However, in contrast thereto, the adapter 122, which is shown in section EE in FIG. 11, now comprises a bore 21 in which a heating element 22 is arranged. Air blown into the bore 21 spreads over the heating element 22, is heated and dried and passes via the hot air ducts 23 into the interior of the adapter 122, as a result of which the flowable material located therein is heated and dried. In the example shown the heating element 22 is realized as an electric heating element which is connected to a power supply via the connection wires 24. Obviously, heating can occur in a different manner, for example with hot water. As a result of the heating element 22, not only the air flowing past is heated but also the adapter 122 as such. Blowing air into the bore 21 is certainly advantageous, but not absolutely necessary. Only heating the adapter 122 is also conceivable. The adapter 122 comprises five hot air ducts 23 going out from the bore 21 in the example shown. Any other number of hot air ducts 23 is naturally also conceivable.

Figure 11:
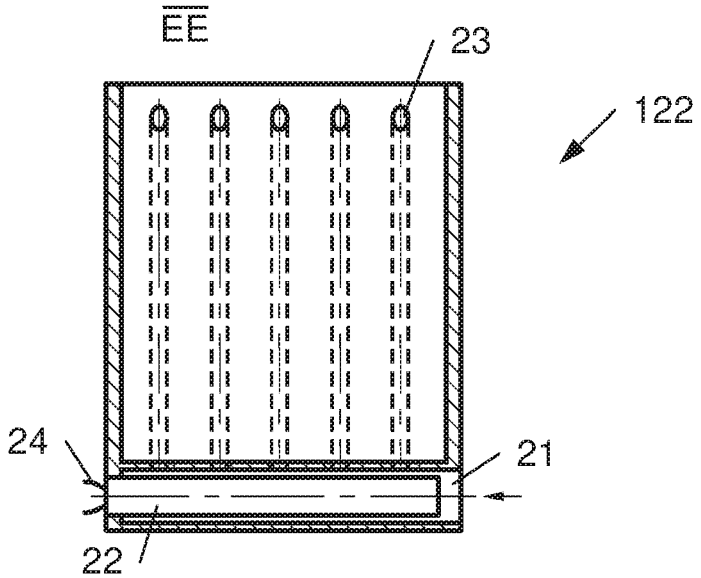
FIG. 11 shows a sectional representation of the adapter from FIG. 10.
Figure 12:
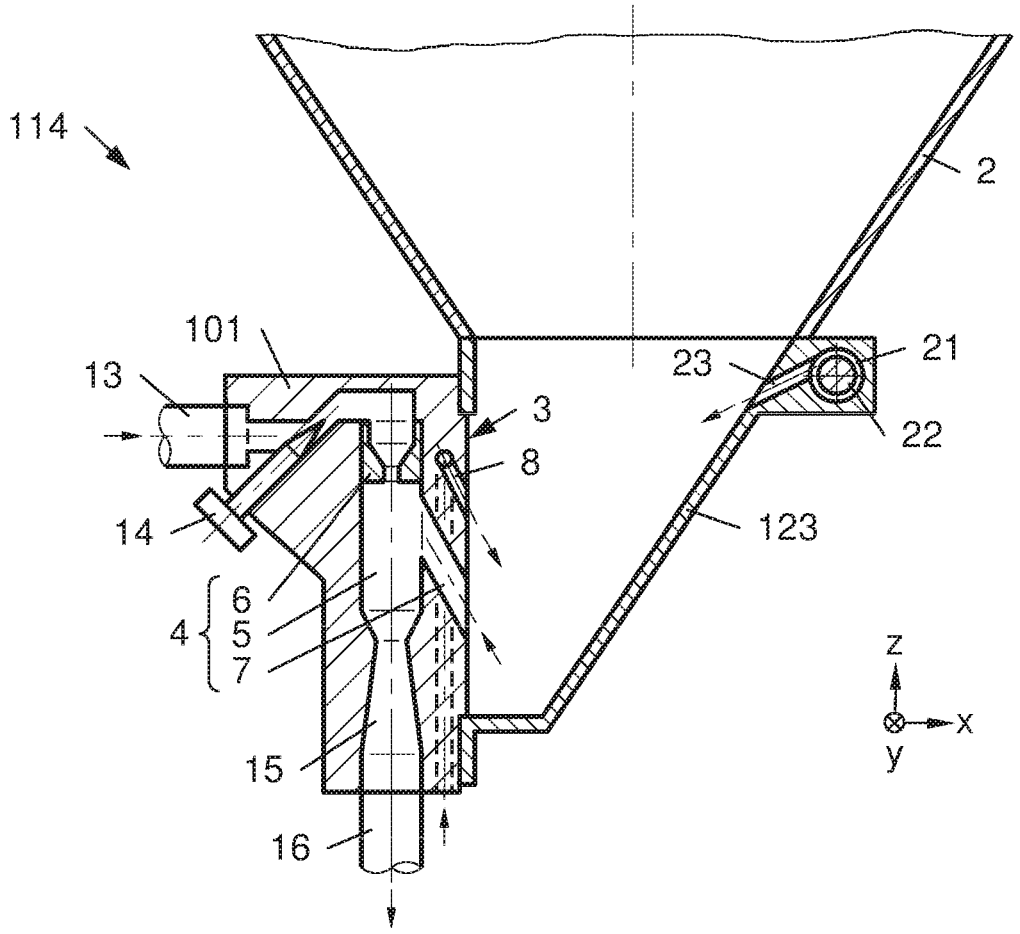
FIG. 12 shows a metering system with a somewhat differently designed, heatable adapter.

FIG. 12 then shows a further example of a metering system 114 which is very similar to the metering system 113 shown in FIGS. 10 and 11. In contrast thereto, however, the adapter 123 comprises an elevated bore 21 with a heating element 22 arranged therein. What has been the in relation to FIGS. 10 and 11 also applies analogously to FIG. 12.

Figure 13:
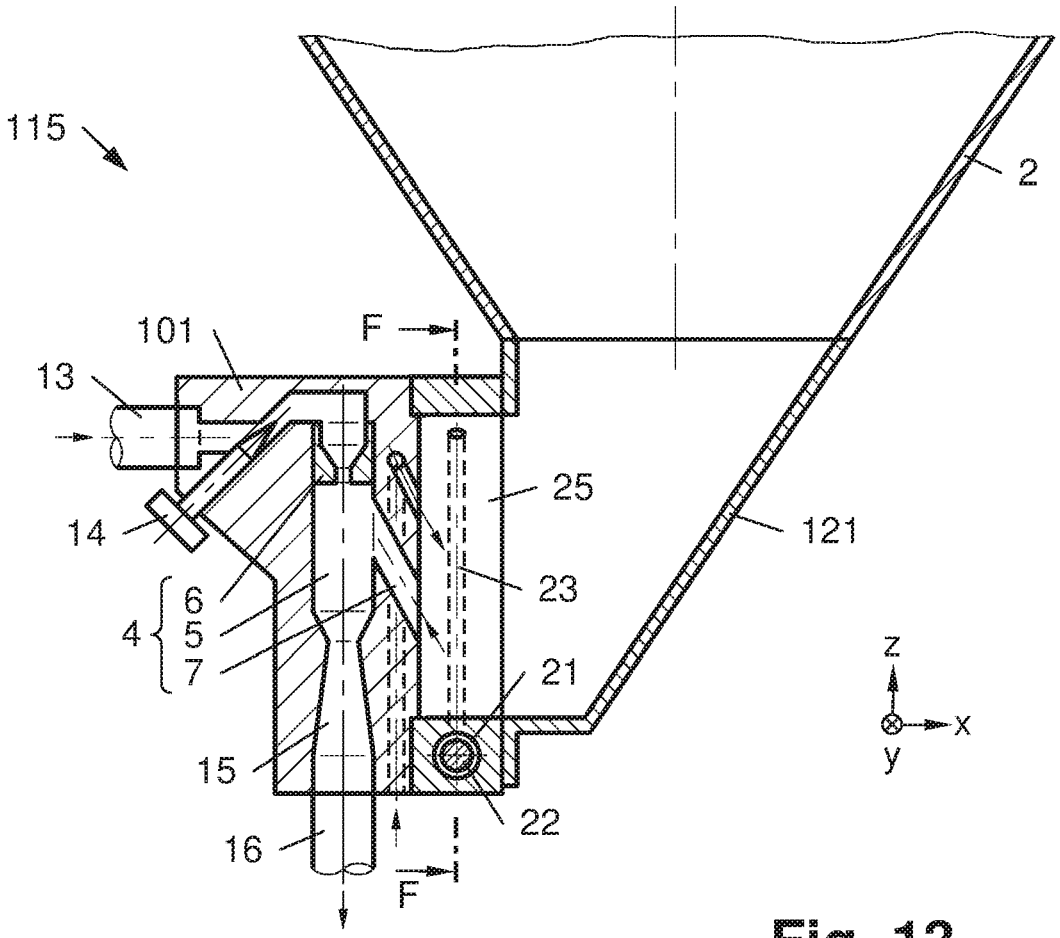
FIG. 13 shows a metering system with a heatable heating flange.
Figure 14:
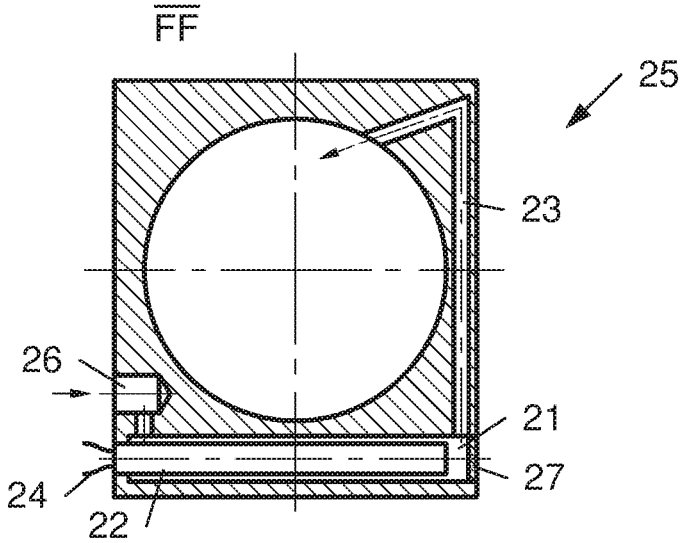
FIG. 14 shows a sectional representation of the heating flange from FIG. 13.

FIG. 13 shows a further metering system 115 which is very similar to the metering system 111 shown in FIG. 2. In contrast thereto, a heating flange 25 is now provided which is shown in section FF in FIG. 14. The heating flange 25 comprises, as the adapters 122 and 123 from FIGS. 10 to 12, a bore 21 in which a heating element 22 is arranged. Air blown into the bore 26 spreads over the heating element 22, is heated and dried and passes via the hot air duct 23 into the interior of the heating flange 25, as a result of which the flowable material located therein is heated and dried. In order to ensure that the heated air emerges via the hot air duct 23, the bore 21 is closed with a plug 27.

The heating element 22 is realized in the example shown once again as an electric heating element which is connected to a power supply via the connection wires 24. Obviously, heating can occur in a different manner, for example with hot water. As a result of the heating element 22, not only the air flowing past is heated but also the heating flange 25 as such. Blowing air into the bore 26 is certainly advantageous, but not absolutely necessary. Only heating the heating flange 25 is also conceivable. The heating flange 25 comprises one hot air duct 23 going out from the bore 21 in the example shown. Any other number of hot air ducts 23 is naturally also conceivable.

In the examples shown, the hot air ducts 23 point in a downward direction at an angle at each of their ends into the volume filled by flowable material such that the flowable material is not able to penetrate into the hot air ducts 23. It is conceivable for a hot air duct 23, instead of this or in addition to it, to be protected against ingress of flowable material by a filter element. For example, such a filter element can be arranged in the course of the hot air duct 23. A filter element against the ingress of flowable material is also conceivable for the supply air ducts 8 and can also be arranged in the course thereof.

In general, the heating flange 25 can be realized as a separate part which is connected, when required, to the pneumatic pump device 101 or to the adapter 121, or the heating flange 25 can also be directly part of the pneumatic pump device 101 or part of the adapter 121. The pneumatic pump device 101, the heating flange 25 and the adapter 121 (and also of the container 2) can also be realized in one part.

It is also noted at this point that the blow-out device 17, the adapter 122, 123 and the heating flange 25 can form the basis for inventions independent of claim 1.

Figure 15:
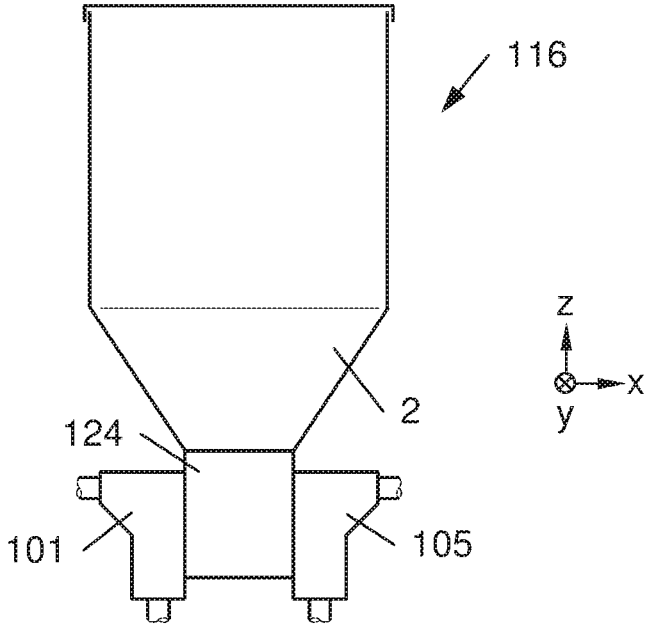
FIG. 15 shows a schematically shown example of a metering system with two pneumatic pump devices and FIG. 16 shows a schematically shown example of a sanding system in a rail vehicle.

FIG. 15 then shows a further realization variant of a metering system 116 which is very similar to the metering system 111 shown in FIG. 1. In contrast thereto, however, not an adapter 121 . . . 123 but an adapter 124 is installed, to which two pneumatic pump devices 101, 105 are connected. In this way, two different transport lines 16 can be used for removing the flowable material. In particular, the differently designed pneumatic pump devices 101, 105 can comprise, for example, variously oriented jet nozzles 6 or transport lines 16 (compare FIGS. 3 to 6). The differences in design can naturally also relate to other aspects, for example to the arrangement of the suction bores and supply air bores 10 (compare FIGS. 3 and 8). A modular system for metering systems 110 . . . 116 can also be constructed by means of multiple adapters 121 . . . 124.

Figure 16:
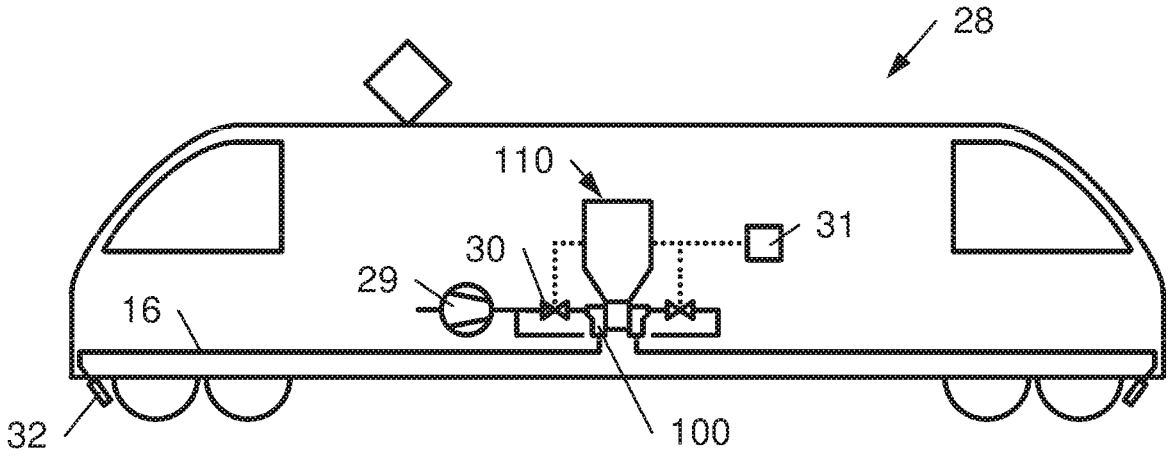

In general, the pneumatic pump devices 101 . . . 105 or metering systems 110 . . . 116 put forward can be used in a sanding system of a rail vehicle, brake sand being provided as flowable material. To this end, FIG. 16 shows a schematic example of a rail vehicle 28.

The sanding system includes a metering system 110, a compressor or rather a compactor 29, two valves 30, a control unit 31 and two downpipes 32. The compressor 29, which is frequently present anyway in a rail vehicle 28, is connected via compressed air lines to the two pneumatic pump devices 100, a controllable valve 30 being mounted upstream of each pump device 100. The controllable valves 30 are connected to the control unit 31 by means of control lines. The two transport lines 16 lead once again to the two downpipes 32 which are arranged in the region of the wheels of the rail vehicle 28. In the specific example, the rail vehicle 28 includes one single sanding system, in principle naturally multiple sanding systems could also be provided.

When there is braking, the control unit 20 causes the compressor 29 to be activated (insofar as the compressor 29 is not running anyway) and one of the two valves 30 to be opened. As a result, brake sand is pumped from the container 2 to the downpipe 32 and from there drops in front of the wheels of the rail vehicle 28 in order to increase the traction when braking and when starting. Depending on the direction of travel of the rail vehicle 28, the left or right valve 30 is actuated.

Generally speaking, an angle of inclination of the suction ducts 7 and of the supply air ducts 8 in relation to the vertical of a maximum of 40° has been shown for flowable material in general and for brake sand in particular (see also the angles $\alpha$ or $\alpha+\beta$ in FIG. 7). As a result, flowable material/brake sand flowing out in an unwanted manner is avoided. Optionally, the brake sand when the distance c between a suction opening 9 and the nearest supply air opening 10 may be a maximum of 30 mm (see FIG. 4). As a result, particularly advantageous flow conditions are produced in the container 2 or rather in the adapter 121 . . . 124 and as a consequence the container 2 is properly emptied.

The exemplary embodiments show possible realization variants of a pneumatic pump device 100 . . . 105, of a metering system 110 . . . 116, or rather of a sanding system, as well as of a rail vehicle 28. However, the disclosed embodiments are not restricted to the specially shown realization variants of the same, but rather diverse combinations of the individual realization variants with one another are possible and the variation possibilities lie within the knowledge of the expert active in the technical area on account of the technical information provided by the object of the invention. All the conceivable realization variants which are possible as a result of combinations of individual details of the realization variants shown and described, are therefore included in the scope of protection.

In particular, it is pointed out that, although part of the exemplary embodiments is directed to the use of the pneumatic pump device 100 . . . 105 or rather of the metering system 110 . . . 116 in a sanding system of a rail vehicle 28, the pneumatic pump device 100 . . . 105 or rather the metering system 110 . . . 116 can naturally also be used in other technical areas, for example in industrial and/or chemical installations for pumping or rather metering substances to be processed.

It should be understood that in reality the devices shown can also include more or fewer component parts than shown.

It should be understood that, for better understanding of the design of the pneumatic pump device 100 . . . 105, of the metering system 110 . . . 116 of the sanding system as well as of the rail vehicle 28, the components or the components thereof have been shown in part not to scale and/or enlarged and/or reduced.

LIST OF REFERENCES

100 . . . 105 Pneumatic pump device
2 Container for flowable material
3 Contact surface
4 Jet pump
5 Mixing chamber
6 Jet nozzle
7 Suction duct
8 Supply air duct/false air duct
9 Suction opening
10 Supply air opening
110 . . . 116 Metering system
121,124 Adapter

13 Compressed air connection
14 Pressure adjusting screw
15 Laval nozzle
16 Transport line
17 Blow-out device
18 Compressed air connection
19 Annular duct
20 Blow-out duct
21 Bore
22 Heating element
23 Hot air duct
24 Connecting wire
25 Heating flange
26 Bore
27 Plug
28 Rail vehicle
29 Compressor/compactor
30 Valve
31 Control unit
32 Downpipe
a Distance between supply air duct/contact surface
b Distance between suction duct/contact surface
c Distance between suction opening/supply air opening
x,y,z Spatial directions
A Straight line for suction openings
B Straight line for supply air openings
C Concave contact surface
D Convex contact surface
α Angle of inclination supply air duct
β Angle between suction duct/supply air duct
y Angle of inclination suction duct

The invention claimed is:

1. A pneumatic pump device for coupling with a container for flowable material, the pump device comprising:

a contact surface for contact with the flowable material;

a jet pump having a mixing chamber, a jet nozzle to be acted upon with pressure and opening out into the mixing chamber and having at least one suction duct which leads away from the contact surface and is configured to provide suction in a direction away from the contact surface and into the mixing chamber; and at least one supply air duct which leads away from the contact surface and to be acted upon with pressure or opens out at an outside surface of the pneumatic pump device, wherein the at least one suction duct and the at least one supply air duct provide at least one suction opening and at least one supply air opening in the region of the contact surface, wherein the at least one suction duct and the at least one supply air duct are oriented substantially identically in the region of the contact surface, and wherein, when the pneumatic pump device is operating, the flow directions are aligned in an anti-parallel manner in at least one suction duct and in the at least one supply air duct.

2. The pneumatic pump device of claim 1, wherein each angle is:

between a suction duct (7) and a supply air duct (8), and/or between two suction ducts (7), and/or between two supply air ducts (8), is less than 30° in the region of the contact surface.

3. The pneumatic pump device of claim 1, wherein the contact surface is level.

4. The pneumatic pump device of claim 1, wherein the contact surface is curved concavely or convexly.

5. The pneumatic pump device of claim 1, wherein the at least one supply air opening is realized smaller in cross section than the at least one suction opening.

6. The pneumatic pump device of claim 1, wherein multiple suction openings of multiple suction ducts are arranged on the contact surface along a first straight line and multiple supply air openings of multiple supply air ducts are arranged on the contact surface along a second straight line parallel to the first straight line.

7. The pneumatic pump device of claim 1, further comprising a Laval nozzle which is arranged downstream of the mixing chamber in the pumping direction of the flowable material.

8. The pneumatic pump device of claim 1, wherein a jet direction of the jet nozzle is aligned horizontally or comprises a horizontal component.

9. The pneumatic pump device of claim 1, wherein a straight portion of the at least one suction duct which begins at the contact surface is guided further away from the contact surface than a straight portion of the at least one supply air duct which begins at the contact surface.

10. The pneumatic pump device of claim 1, wherein a straight portion of the at least one suction duct which begins at the contact surface and a straight portion of the at least one supply air duct which begins at the contact surface are at an angle with respect to one another away from the pneumatic pump device in the direction of the container.

11. A method of using a pneumatic pump device to suck up the flowable material from a container, wherein the pneumatic pump device includes a contact surface for contact with the flowable material, a jet pump having a mixing chamber, a jet nozzle to be acted upon with pressure and opening out into the mixing chamber and having at least one suction duct which leads away from the contact surface and is configured to provide suction in a direction away from the contact surface and into the mixing chamber, and at least one supply air duct which leads away from the contact surface and acted upon with pressure or opens out at an outside surface of the pneumatic pump device, the method comprising:

providing, via the at least one suction duct and the at least one supply air duct, at least one suction opening and at least one supply air opening in the region of the contact surface, wherein the at least one suction duct and the at least one supply air duct are oriented substantially identically in the region of the contact surface, and when the pneumatic pump device is operating, aligning the flow directions in an anti-parallel manner in at least one suction duct and in the at least one supply air duct, wherein at least one suction duct and the at least one supply air duct are at angle of no more than 40° in relation to the vertical in the region of the contact surface.

12. The method of claim 11, wherein a supply air opening which is nearest to a suction opening is arranged above the named suction opening.

13. The method of claim 11, wherein the contact surface of the pneumatic pump device is level and aligned vertically.

14. The method of claim 13, wherein multiple suction openings of multiple suction ducts are arranged on the contact surface along a first straight line and multiple supply air openings of multiple supply air ducts are arranged on the contact surface along a second straight line parallel to the first straight line, and wherein the first straight line and the second straight line of the pneumatic pump device are aligned substantially horizontally.

15. A metering system comprising:

a container for receiving flowable material; and a pneumatic pump device coupled with the container and including a contact surface for contact with the flowable material, a jet pump having a mixing chamber positioned within the pump device, a jet nozzle to be acted upon with pressure and opening out into the mixing chamber and having at least one suction duct which leads away from the contact surface and opens out into the mixing chamber, and at least one supply air duct which leads away from the contact surface and is acted upon with pressure or opens out at an outside surface of the pneumatic pump device, wherein the at least one suction duct and the at least one supply air duct provide at least one suction opening and at least one supply air opening in the region of the contact surface, the at least one suction duct and the at least one supply air duct are oriented substantially identically in the region of the contact surface, wherein, when the pneumatic pump device is operating, the flow directions are aligned in an anti-parallel manner in at least one suction duct and in the at least one supply air duct, and wherein the contact surface of the pneumatic pump device points into an interior of the container.

16. The metering system of claim 15, wherein the pneumatic pump device is arranged in its entirety outside the container.

17. The metering system of claim 15, wherein the container tapers toward the contact surface of the pneumatic pump device.

18. The metering system of claim 17, wherein the tapering part is formed at least in the end region by an adapter.

19. The metering system 15, further comprising a blow-out device with blow-out ducts which are arranged in the pumping direction of the flowable material behind the mixing chamber; and a Laval nozzle, wherein the blow-out ducts are located behind the Laval nozzle and both are aligned at an angle to the pumping direction of the flowable material and point in the named pumping direction.

20. The metering system of claim 15, further comprising a heating unit and/or at least one hot air duct which opens out into a space for the flowable material.

21. The metering system of claim 15, further comprising a plurality of the pneumatic pump devices connected to the container.

22. The metering system of claim 21, wherein at least two of the plurality of pneumatic pump devices are configured to supply the pipe systems differently from each other or are configured to meet different output requirements.

23. A modular system comprising:

a metering system that includes:

a container for receiving flowable material;

a pneumatic pump device coupled with the container that includes a contact surface for contact with the flowable material, a jet pump having a mixing chamber positioned within the pump device, a jet nozzle to be acted upon with pressure and opening out into the mixing chamber and having at least one suction duct which leads away from the contact surface and opens out into the mixing chamber, and at least one supply air duct which leads away from the contact surface and acted upon with pressure or opens out at an outside surface of the pneumatic pump device, wherein the at least one suction duct and the at least one supply air duct provide at least one suction opening and at least one supply air opening in the region of the contact surface, the at least one suction duct and the at least one supply air duct are oriented substantially identically in the region of the contact surface, wherein, when the pneumatic pump device is operating, the flow directions are aligned in an anti-parallel manner in at least one suction duct and in the at least one supply air duct, wherein the contact surface of the pneumatic pump device points into an interior of the container, and wherein the container tapers toward the contact surface of the pneumatic pump device and the tapering part is formed at least in the end region by an adapter; and at least two of adapters that are designed differently from one another.

24. A method of using a pneumatic pump device or a metering system in a sanding system of a rail vehicle, wherein the metering system includes at least one pneumatic pump device and a container for receiving flowable material, wherein the pneumatic pump device is coupled with the container and includes a contact surface for contact with the flowable material, a jet pump having a mixing chamber, a jet nozzle to be acted upon with pressure and opening out into the mixing chamber and having at least one suction duct which leads away from the contact surface and opens out into the mixing chamber, and at least one supply air duct which leads away from the contact surface and acted upon with pressure or opens out at an outside surface of the pneumatic pump device, wherein the method comprises:

at least one suction duct and the at least one supply air duct providing at least one suction opening and at least one supply air opening in the region of the contact surface, the at least one suction duct and the at least one supply air duct being oriented substantially identically in the region of the contact surface;

when the pneumatic pump device is operating, aligning the flow directions in an anti-parallel manner in at least one suction duct and in the at least one supply air duct, and wherein the contact surface of the pneumatic pump device points into an interior of the container, and wherein brake sand is provided as the flowable material.

25. A sanding system for a rail vehicle including a metering system that includes a container for receiving flowable material, and a pneumatic pump device coupled with the container that includes a contact surface for contact with the flowable material, a jet pump having a mixing chamber positioned within the pump device, a jet nozzle to be acted upon with pressure and opening out into the mixing chamber and having at least one suction duct which leads away from the contact surface and opens out into the mixing chamber, and at least one supply air duct which leads away from the contact surface and acted upon with pressure or opens out at an outside surface of the pneumatic pump device, wherein the at least one suction duct and the at least one supply air duct provide at least one suction opening and at least one supply air opening in the region of the contact surface, the at least one suction duct and the at least one supply air duct are oriented substantially identically in the region of the contact surface, wherein, when the pneumatic pump device is operating, the flow directions are aligned in an anti-parallel manner in at least one suction duct and in the at least one supply air duct, and wherein the contact surface of the pneumatic pump device points into an interior of the container.

26. The sanding system of claim 25, wherein the distance between a suction opening and the nearest supply air opening is no more than 30 mm.

27. A rail vehicle including a sanding system that includes a metering system including a container for receiving flowable material, and a pneumatic pump device coupled with the container that includes a contact surface for contact with the flowable material, a jet pump having a mixing chamber positioned within the pump device, a jet nozzle to be acted upon with pressure and opening out into the mixing chamber and having at least one suction duct which leads away from the contact surface and opens out into the mixing chamber, and at least one supply air duct which leads away from the contact surface and acted upon with pressure or opens out at an outside surface of the pneumatic pump device, wherein the at least one suction duct and the at least one supply air duct provide at least one suction opening and at least one supply air opening in the region of the contact surface, the at least one suction duct and the at least one supply air duct are oriented substantially identically in the region of the contact surface, wherein, when the pneumatic pump device is operating, the flow directions are aligned in an anti-parallel manner in at least one suction duct and in the at least one supply air duct, and wherein the contact surface of the pneumatic pump device points into an interior of the container.

* * * * *